US007444725B1

(12) United States Patent
Wimprine, Jr.

(10) Patent No.: US 7,444,725 B1
(45) **Date of Patent: *Nov. 4, 2008**

(54) PERSONALIZED IDENTIFICATION SYSTEM FOR LOVED ONES

(76) Inventor: Ronald Wimprine, Jr., 413 N. Bengal Rd., Metairie, LA (US) 70003

( * ) Notice: Subject to any disclaimer, the term of this patent is extended or adjusted under 35 U.S.C. 154(b) by 0 days.

This patent is subject to a terminal disclaimer.

(21) Appl. No.: 11/742,915

(22) Filed: May 1, 2007

Related U.S. Application Data

(63) Continuation of application No. 11/269,026, filed on Nov. 7, 2005, now Pat. No. 7,210,203.

(60) Provisional application No. 60/627,857, filed on Nov. 15, 2004.

(51) Int. Cl.
*A61G 17/00* (2006.01)

(52) U.S. Cl. ..... 27/1; 40/633

(58) Field of Classification Search ..... 27/1; 40/633; 63/3, 3.1, 33; 705/1
See application file for complete search history.

(56) References Cited

U.S. PATENT DOCUMENTS

| | | | |
|---|---|---|---|
| 1,246,753 | A | 11/1917 | Taylor |
| 2,359,988 | A | 10/1944 | Gudebrod |
| 4,154,011 | A | 5/1979 | Rakestraw et al. |
| 4,208,795 | A | 6/1980 | Mühlemann et al. |
| 4,324,026 | A | 4/1982 | Craft |
| 6,747,561 | B1 | 6/2004 | Reeves |
| 6,948,271 | B2 | 9/2005 | Helgeson et al. |
| 7,210,203 | B1 | 5/2007 | Wimprine, Jr. |
| 2002/0054940 | A1 | 5/2002 | Grose et al. |
| 2004/0068905 | A1 | 4/2004 | Helgeson et al. |
| 2004/0095242 | A1 | 5/2004 | Grose et al. |
| 2006/0137154 | A1 | 6/2006 | Bills |

OTHER PUBLICATIONS

Reha, Bob, "Fargo Man Invents New Identification Program", Minnesota Public Radio, Jul. 5, 2004.

McEwen, Craig, "Adding peace of mind: Tag system tracks cremated remains", The Forum, Jun. 22, 2004.

*Primary Examiner*—William L. Miller
(74) *Attorney, Agent, or Firm*—Garvey, Smith, Nehrbass & North, L.L.C.; Brett A. North

(57) ABSTRACT

An identification system for deceased bodies is disclosed. The system includes a personalized item of jewelry, such as a bracelet, attached to the decedent's body. Additionally, the item of jewelry and personalized message remains intact throughout the cremation process.

19 Claims, 4 Drawing Sheets

PERSONALIZED IDENTIFICATION SYSTEM FOR LOVED ONES

CROSS-REFERENCE TO RELATED APPLICATIONS

This is a continuation of U.S. patent application Ser. No. 11/269,026, filed Nov. 7, 2005, now U.S. Pat. No. 7,210,203, which is incorporated herein by reference.

Priority of U.S. Provisional Patent Application Ser. No. 60/627,857, filed Nov. 15, 2004, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

The present invention is directed to a personalized system for identifying and tracking the deceased body of a loved one before, during, and after cremation. In particular, the method of the present invention is directed to tracking the loved one's deceased body including the funeral home, the crematorium, and final storage of the cremated remains.

There is a risk that deceased bodies will be mistakenly switched at funeral homes or crematoriums. Such an occurrence is traumatic to the decedent's family and friends, and can be a source of liability for the funeral home or crematorium.

Attempts have been made to place identification tags or other sort of identification means on bodies to reduce the occurrence of mistaken identity. However, such attempts have disadvantages where the identification means are not personalized and not thereby allowing ease of identification by the decedent's family or loved ones. Additionally, such attempts do not allow loved ones the means of having jewelry as the means of identification.

What is desired is an identification system for deceased bodies that can be personalized by the decedent's family or loved ones, personally attached by family or loved ones, and once attached, stays with the body throughout the cremation process, ultimate storage of the cremated remains, or burial process. The family or loved ones can view the cremated remains and personalized identification system thereby providing ease of mind for the family or loved ones confirming that the cremated remains are that of the decedent.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner.

What is provided is a personalized identification system and method for identification of deceased bodies which are cremated. In one embodiment the system includes an identification means, such as an item of jewelry or bracelet, that has been personalized by the family or loved ones of the decedent, attached to the decedent's body by the family or loved ones, and follows the decedent's body during the cremation process and ultimate storage of the cremated remains. Additionally, the identification means remains intact throughout the cremation process and can be viewed by individuals receiving the remains of the cremated body.

One embodiment includes a metal bracelet having a personalized message engraved thereon. The personalized message can be engraved on the bracelet and placed on the decedent by family or loved ones.

Once attached to the decedent, such as around a wrist, ankle, or neck, the bracelet will remain on the decedent throughout the cremation process and ultimate storage of the cremated remains. The bracelet and personalized message will not be destroyed by the high temperatures of the cremation process.

One embodiment includes using a item of jewelry with a personalized message for identification of the body during transportation and burial.

The personalized message can be included in a database or tracking system.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
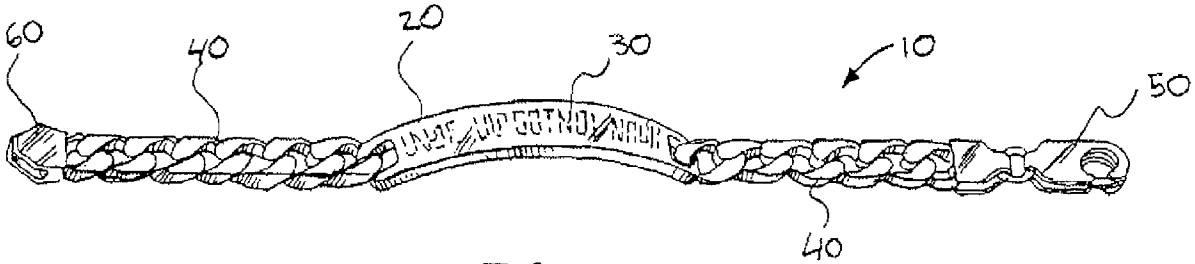
FIG. 1 is a perspective view of a personalized bracelet for use with the method of the present invention.

FIG. 1 is a perspective view of a jewelry 10, such as a bracelet, for use with the method of the present invention. Item of jewelry 10 can be a bracelet comprising a base 20, chain 40, clasp 50, and receiver for clasp 60. Base 20 can include personalized message 30 which can be personally selected by a family member or loved one to identify a decedent 100. Base 20 and chain 40 can be decorative jewelry style and aesthetically pleasing.

Jewelry 10 can be any objects of personal adornment, such as necklaces, bracelets, or broaches. It can include items made of gemstones, pearls, or other organic elements and having fine design and craft.

Figure 2:
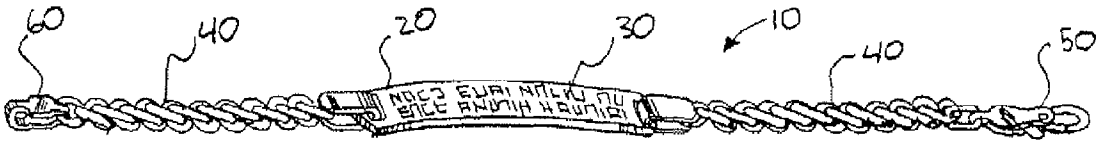
FIG. 2 is a perspective view of an alternative style personalized bracelet for use with the method of the present invention.

FIG. 2 is a perspective view of an alternative item of personalized jewelry 10, such as a bracelet for use with the method of the present invention. As with the bracelet of FIG. 1, jewelry 10 can be a bracelet comprising base 20, chain 40, clasp 50, and receiver for clasp 60. Base 20 can include personalized message 30 which can be personally selected by a family member or loved one to identify a decedent 100. A different style chain 40 is shown in FIG. 2 compared to the chain in FIG. 1.

Figure 3:
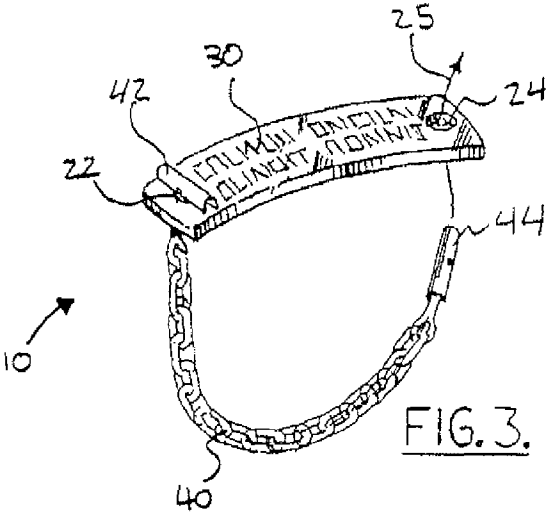
FIG. 3 is a drawing of another alternative style personalized bracelet for use with the method of the present invention.
Figure 4:
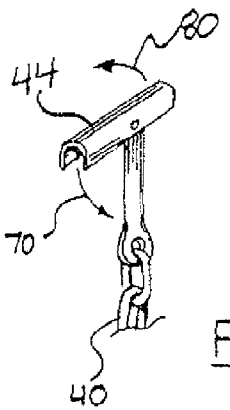
FIG. 4 schematically shows the steps in clasping the personalized bracelet of FIG. 3.

FIG. 3 is a drawing of another item of personalized jewelry 10 for use with the method of the present invention. In this embodiment jewelry 10 can be a bracelet comprising base 20 and chain 40. Base 20 can include personalized message 30 which can be personally selected by a family member or loved one to identify a decedent 100. Base 20 can include first and second openings 22,24. On chain 40 can be attached first and second connectors 42,44. First and second connectors 42,44 can connect to first and second openings 22,24. FIG. 4 schematically shows the steps in connecting first connector 42 to either first or second opening 22,24. First connector 42 can be twisted in the direction of arrows 70,80 to have it align with chain 40 and then inserted into either first or second opening 22,24. After being inserted first connector 42 is released and moves back into a perpendicular direction relative to chain 40. FIG. 3 illustrates first connector 42 after insertion into first opening 22. Second connector 44 can be inserted into second opening 24 in relatively the same manner.

Figure 5:
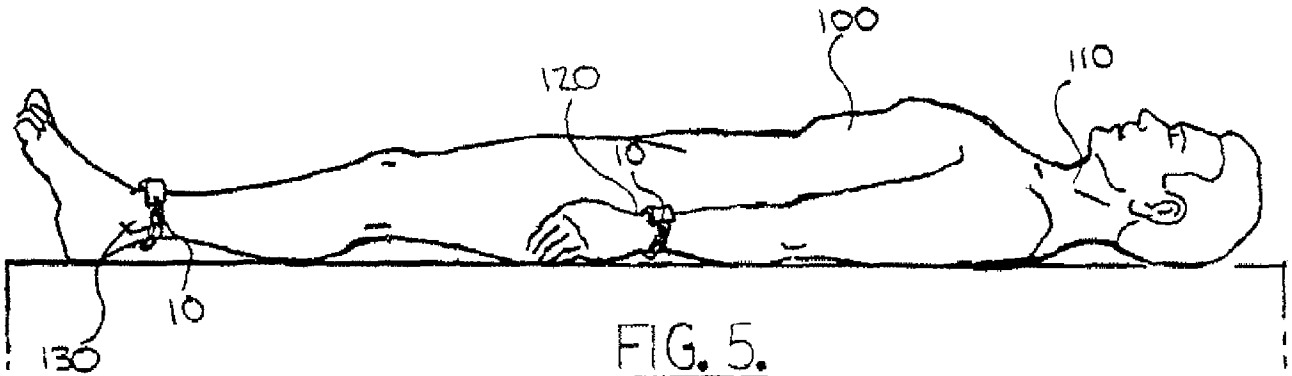
FIG. 5 is a schematic view of a decedent having a personalized bracelet placed in two possible locations.

Jewelry 10, such as a bracelet, can be sized for attachment to selected body area of the decedent, for example, the wrist, neck, or ankle. FIG. 5 is a schematic diagram of a decedent 100 having personalized items of jewelry 10 placed in two possible locations. The first location is at wrist 120. The second location is at ankle 130. A third location could be neck 110. However, it is understood that only one item of jewelry 10 will typically be used to identify decedent 100.

Figure 7:
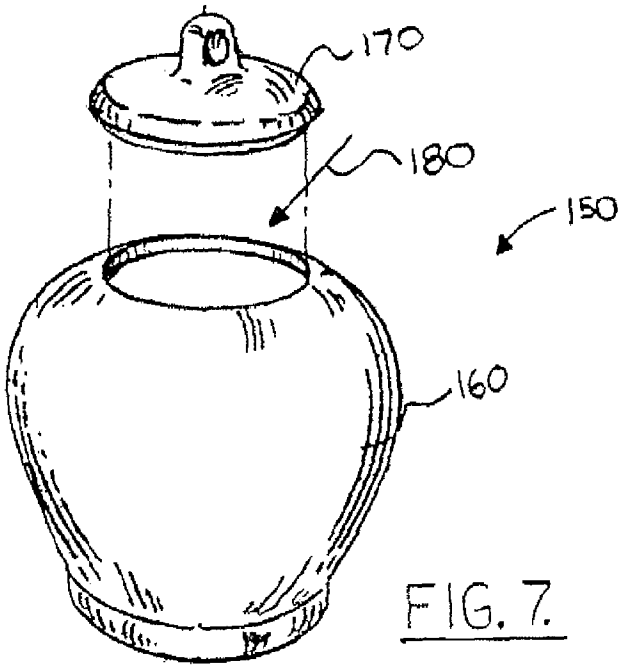
FIG. 7 shows the storage container of FIG. 6, with the top removed.
Figure 6:
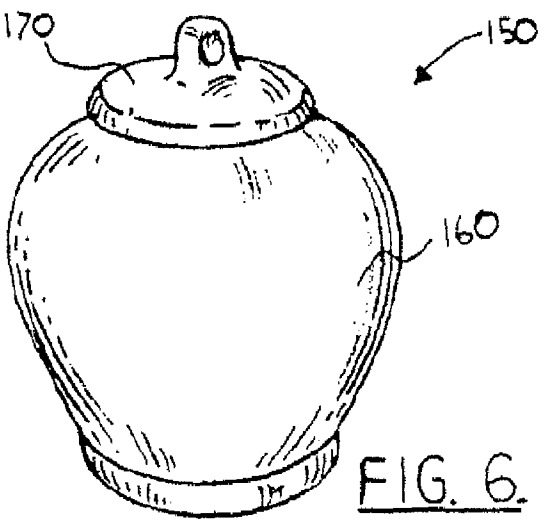
FIG. 6 shows a storage container for cremated remains.

FIG. 6 shows a storage container 150 for cremated remains of decedent 100. Storage container 150 can comprise base 160 and cover 170. FIG. 7 shows storage container 150 where top 170 has been removed from base 160.

Figure 8:
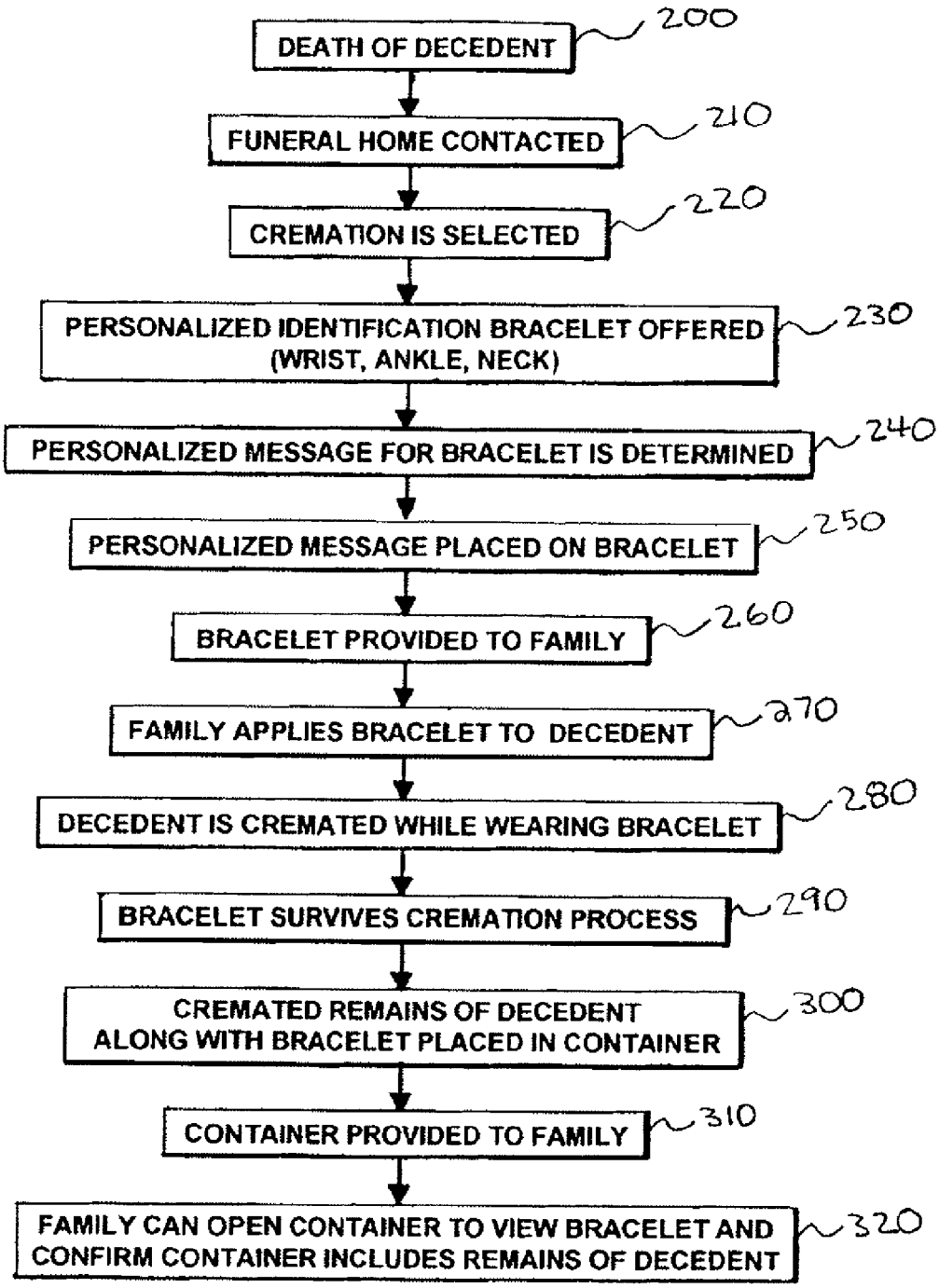
FIG. 8 is a diagram illustrating various steps in one embodiment of the method.
Figure 9:
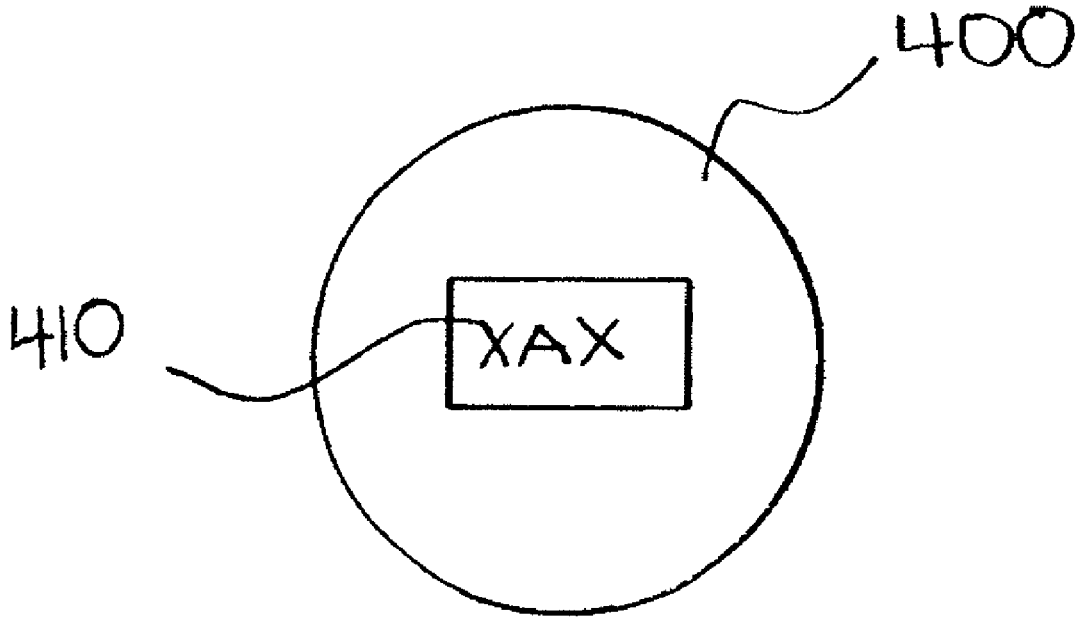
FIG. 9 is a schematic diagram showing one example of a lapel pin having a personalized message.

FIG. 8 is a diagram illustrating various steps in one embodiment of the method. Step 200 indicates a death of decedent 100. Step 210 indicates that a funeral home is contacted by decedent's 100 family or loved ones. Step 220 indicates that cremation is selected for decedent 100 by the family or loved ones. Step 230 indicates that the family or loved ones are provided the option of selecting a personalized identification item of jewelry 10, such as a bracelet. The personalized identification item of jewelry 10, can be placed on decedent by the family or loved ones at a selected location such as the wrist, ankle, or neck. Step 240 indicates that the family or loved ones select a personalized message 30 for item of jewelry 10, such as a bracelet. Personalized message 30 can be selected from a group of available messages or can be independently created by the family or loved ones. Step 250 indicates that the personalized message 30 is placed on the item of jewelry 10. Step 280 indicates that the item of jewelry 10 is provided to the family or loved ones. Step 280 indicates that the family or loved ones attach the item of jewelry 10 on decedent 100.

Step 280 indicates that decedent 100 is cremated while wearing bracelet 10. Step 290 indicates that item of personalized jewelry 10, along with personalized message 30, survives the cremation process. Step 300 indicates that the cremated remains of decedent 100 along with item of personalized jewelry 10 are placed in container 150. Step 310 indicates that container 150 is provided to family or loved ones. Step 320 indicates family or loved ones opening container 150 to view item of personalized jewelry 10 and personalized message 30 to confirm that container 150 includes the remains of decedent 100.

The components of item of personalized jewelry 10, such as bracelet, can be made from materials suitable for withstanding the conditions for cremation. Base 20, chain 40, and its connecting means should be constructed of materials which can withstand the high temperatures of the cremation process (between 1,600 to 1,900 degrees Fahrenheit for up to 6 hours). Suitable materials can include metals having a melting point of greater than about 2000 degrees Fahrenheit. Such materials can include metals such as steel (mild steel, stainless steel, hard steel), wrought iron, chromium, nickel, palladium, platinum, titanium, tungsten, and various alloys thereof. Stainless steels are preferred materials, due to their high temperature resistance and malleability (such as 310SS). The various portions of item of personalized jewelry 10 can be made from the same or different materials. Some ceramic materials may also be suitable.

Personalized message 30 can be any message chosen by family or loved ones. It can contain any combination of numbers, alpha characters, geometric shapes, symbols, or combinations thereof. Personalized message 30 can include a message selected for decedent from a set of available personal messages. Personalized message 30 can include decedent's 100 name, nickname, date of birth, social security number, telephone number, or "luck numbers". Item of personalized jewelry 10 may include an area where the decedent's 100 name, date of birth, social security number, telephone number, or other personal identifying information is provided; this area could be on the front or rear of base 20. This personal information could be permanent (such as by etching, embossing, etc.), or by other means, such as by marker. Item of personalized jewelry 10, such as a bracelet, may also include an area where a specific identification number is placed such as a serial number. This specific identification number can be used to track item of personalized jewelry 10 in addition to personalized message 30.

At the crematorium as decedent 100 enters the retort, a crematorium employee can confirm that personalized message 30 on item of jewelry 10 matches what is registered for decedent 100. Alternatively, a serial number on personalized bracelet 20 can be checked by the crematorium employee. As the cremated remains of decedent 100 are removed from the retort, item of personalized jewelry 10 can be checked as a confirmation of the proper identification of the remains.

In one embodiment bracelet 10 can be mounted on the exterior of storage container 150. This embodiment would avoid the need to open storage container 150 to confirm that personalized message 30 on item of jewelry 10 matches decedent 100.

In one embodiment a lapel pin 400 having a personalized message 410 could be used. Lapel pin 400 could be made out of the same materials as item of personalized jewelry 10 and could also be decorative.

In one embodiment a display case of decorative items of jewelry 10 or lapel pins 400 could be shown to family or loved ones. In another embodiment a catalog of decorative items of jewelry 10 or lapel pins 400 could be shown to family or loved ones.

In one embodiment item of personalized jewelry 10 can be used for confirmation on a pet's cremated remains. In this embodiment it is expected that the veterinarian will offer to the pet owner the option of using an item of personalized jewelry 10.

In one embodiment item of personalized jewelry 10 can be used for confirmation decedent's 100 body after temporary storage or burial. For example, after death decedent 100 may be transferred from a temporary crypt or tomb to a mausoleum for final burial. Such may have been required because the mausoleum took some time to complete after death. Additionally, after being buried the body of decedent 100 may be exhumed for various reasons. In these situations to provide peace of mind to family or loved ones, the option of using an item of jewelry 10 with personalized message 30 can be offered. The method could be similar to that disclosed above where the option of using an item of personalized jewelry 10 with personalized message 30 could be offered to the family or loved ones.

The following is a list of reference numerals:

LIST FOR REFERENCE NUMERALS

| (Reference No.) | (Description) |
|---|---|
| 10 | item of jewelry, such as bracelet |
| 20 | base |
| 22 | first opening |
| 24 | second opening |
| 30 | personalized message |
| 40 | chain |
| 42 | first connector |
| 44 | second connector |
| 50 | clasp |
| 60 | receiver for clasp |
| 70 | arrow |
| 80 | arrow |
| 100 | decedent |
| 110 | neck |
| 120 | wrist |
| 130 | ankle |
| 150 | container |
| 160 | base |
| 170 | cover |
| 180 | arrow |
| 200 | step |
| 210 | step |
| 220 | step |
| 230 | step |
| 240 | step |
| 250 | step |
| 260 | step |
| 270 | step |
| 280 | step |
| 290 | step |
| 300 | step |
| 310 | step |
| 320 | step |
| 400 | lapel pin |
| 410 | personalized message |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A method of identifying a set of cremated remains of a deceased body, the method comprising the steps of:

(a) providing an item of jewelry which can be affixed on the deceased body and wherein the item of jewelry is removably connectable to the deceased body;

(b) selecting a personalized message for the item of jewelry;

(c) placing the personalized message on the item of jewelry;

(d) affixing the item of jewelry on the deceased body;

(e) cremating the deceased body which creates the set of cremated remains for the deceased body; and (f) placing the set of cremated remains for the deceased body along with the item of jewelry in a storage container.

2. The method of claim 1, wherein the item of jewelry is a bracelet.

3. The method of claim 1, wherein the personalized message is selected from a database of messages.

4. The method of claim 1, wherein the personalized message is to be created by loved ones of the deceased.

5. The method of claim 1, wherein-the item of jewelry is a bracelet comprising a base, a chain connected to the base, and wherein the chain is comprised of a clasp and a receiver for the clasp, the clasp and receiver being detachably connectable to one another.

6. The method of claim 1, wherein the item of jewelry is a bracelet comprising a base, a chain connected to the base, and wherein the base comprises a pair of openings and the chain comprises first and second ends, and wherein the first and second ends respectively detachably connect to the first and second openings.

7. The method of claim 6, wherein the first and second ends comprise first and second rods, the first and second rods being connected to the chain at about right angles.

8. The method of claim 7, wherein the first and second rods can bend relative to the chain.

9. The method of claim 1, wherein the item of jewelry is provided by a funeral home.

10. The method of claim 1, wherein the item of jewelry is provided by a crematorium.

11. A method of identifying a set of cremated remains of a deceased body, the method comprising the steps of:

(a) providing an item of jewelry which can be placed on the deceased body;

(b) selecting a personalized message for the item of jewelry, wherein the personalized message is to be selected by loved ones of the deceased;

(c) placing the personalized message on the item of jewelry;

(d) affixing the item of jewelry on the deceased body;

(e) cremating the deceased body which creates the set of cremated remains for the deceased body; and (f) placing the set of cremated remains for the deceased body along with the item of jewelry in a storage container.

12. The method of claim 11, wherein the item of jewelry is a bracelet.

13. The method of claim 11, wherein the item of jewelry is removably connectable to the deceased body.

14. The method of claim 11, wherein the item of jewelry is a bracelet comprising a base, a chain connected to the base, and wherein the chain is comprised of a clasp and a receiver for the clasp, the clasp and receiver being detachably connectable to one another.

15. The method of claim 11, wherein the item of jewelry is a bracelet comprising a base, a chain connected to the base, and wherein the base comprises a pair of openings and the chain comprises first and second ends, and wherein the first and second ends respectively detachably connect to the first and second openings.

16. The method of claim 15, wherein the first and second ends comprise first and second rods, the first and second rods being connected to the chain at about right angles.

17. The method of claim 16, wherein the first and second rods can bend relative to the chain.

18. The method of claim 11, wherein the item of jewelry is provided by a funeral home.

19. The method of claim 11, wherein the item of jewelry is provided by a crematorium.

* * * * *